US009797215B2

(12) United States Patent
Ford et al.

(10) Patent No.: US 9,797,215 B2
(45) Date of Patent: Oct. 24, 2017

(54) RATCHETED E-RING RETENTION DEVICE

(71) Applicant: Vetco Gray Inc., Houston, TX (US)

(72) Inventors: David Lawrence Ford, Houston, TX (US); Daniel Ralph Barnhart, Houston, TX (US); Daniel Caleb Benson, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 417 days.

(21) Appl. No.: 14/451,903

(22) Filed: Aug. 5, 2014

(65) Prior Publication Data

US 2016/0040498 A1 Feb. 11, 2016

(51) Int. Cl.

| | |
|---|---|
| ***E21B 33/04*** | (2006.01) |
| ***E21B 33/03*** | (2006.01) |
| *E21B 33/00* | (2006.01) |

(52) U.S. Cl.

CPC ..... *E21B 33/04* (2013.01); *E21B 33/03* (2013.01); *E21B 2033/005* (2013.01)

(58) Field of Classification Search

CPC ..... E21B 33/043; E21B 33/04; E21B 33/038; E21B 33/03; E21B 33/0422; Y10S 285/917

See application file for complete search history.

(56) References Cited

U.S. PATENT DOCUMENTS 3,021,902 A * 2/1962 Keithahn ..... E21B 33/1291 166/138
3,054,451 A 9/1962 Bonner
3,827,488 A 8/1974 Piazza et al.
5,026,097 A * 6/1991 Reimert ..... E21B 33/043 166/208
5,456,314 A 10/1995 Boehm, Jr. et al.
5,586,601 A * 12/1996 Pringle ..... E21B 33/1295 166/120
7,762,319 B2 7/2010 Nelson
8,205,670 B2 6/2012 Nelson
9,141,130 B2 * 9/2015 Ellison ..... E21B 33/038

(Continued)

FOREIGN PATENT DOCUMENTS

GB 2482969 A 2/2012

OTHER PUBLICATIONS

PCT Search Report and Written Opinion issued in connection with corresponding Application No. PCT/US2015/41501 on Feb. 17, 2016.

*Primary Examiner* — Kipp Wallace
(74) *Attorney, Agent, or Firm* — Hogan Lovells US LLP

(57) ABSTRACT

A wellhead assembly includes an outer tubular wellhead member and an inner tubular wellhead member with a seal pocket between them. A seal ring is located in the seal pocket. An annular energizing ring urges the seal ring into sealing engagement with the outer tubular wellhead member and the inner tubular wellhead member. A recess is located on an outer diameter of the annular energizing ring or a radially inner diameter of the seal ring, and a ratcheted retainer is on the other. A ratchet clip with a clip profile is located within the recess. The recess and the ratchet clip extend less than a full circumferential distance around the outer diameter of the annular energizing ring or the radially inner diameter of the seal ring. A retainer profile on the ratcheted retainer selectively engages with the clip profile of the ratchet clip.

16 Claims, 6 Drawing Sheets

(56) References Cited

U.S. PATENT DOCUMENTS

| | | | | |
|---|---|---|---|---|
| 9,175,537 | B2 * | 11/2015 | Gette | E21B 33/03 |
| 2012/0025470 | A1 | 2/2012 | Gette | |
| 2012/0098203 | A1 | 4/2012 | Duong | |
| 2013/0319772 | A1 * | 12/2013 | Bhatia | E21B 17/076<br>175/300 |
| 2014/0110126 | A1 | 4/2014 | Yates et al. | |
| 2015/0159449 | A1 * | 6/2015 | Moyes | E21B 33/134<br>166/217 |

* cited by examiner

RATCHETED E-RING RETENTION DEVICE

BACKGROUND OF THE INVENTION

1. Field of the Invention

The present invention relates in general to subterranean wells, and in particular to a seal with an energizing ring and a retention assembly, for sealing between wellhead members.

2. Brief Description of Related Art

In hydrocarbon production wells, a housing such as a wellhead housing of high pressure housing is located at the upper end of the well. The wellhead housing is a large tubular member having an axial bore extending through it. Casing will extend into the well and will be cemented in place. A casing hanger, which is on the upper end of the casing, will land within the wellhead housing. The exterior of the casing hanger is spaced from the bore of the wellhead housing by an annular clearance which provides a pocket for receiving an annulus seal.

There are many types of annulus seals, including rubber, rubber combined with metal, and metal-to-metal. One metal-to-metal seal in use has a U-shape in cross section, having inner and outer walls or legs separated from each other by an annular clearance, called a seal pocket. An energizing ring, which has smooth inner and outer diameters, is pressed into the seal pocket to force the legs apart to seal in engagement with the bore and with the exterior of the casing hanger.

During operations, cyclic loads and pressures can cause the energizing ring to back away from the annulus seal, allowing the seal to leak. In metal-to-metal seals with U-shaped cross sections, the energizing ring can back out of the seal pocket. Previous assemblies have utilized a single bump feature where a relatively high setting load is required to force the energizing ring to energize the seal ring. A press is required to assemble such assemblies. The energizing ring of such assemblies must be forced within the seal ring until the single bump feature has been passed. If additional axial movement of the energizing ring into the seal ring is required to fully set the seal ring, after the bump feature has been passed, during operation, the energizing ring can back out of the seal ring until the bump feature restricts further axial movement of the energizing ring. This backing out of the energizing ring can cause the seal ring to leak.

SUMMARY OF THE DISCLOSURE

Embodiments of the current disclosure provide a seal assembly with a ratchet retainer and ratcheted clip that prevent the energizing ring from backing out of the seal during operations. The retaining clip can be attached to the energizing ring without a press or any special tools. The retaining clip has sufficient flexibility to allow the seal ring to be set without significantly increasing the setting load over the force required to insert the energizing ring into the seal ring. Due to the number of teeth on the ratcheted retainer and ratchet clip, the operator has flexibility in the placement of the energizing ring relative to the seal ring.

In an embodiment of the current application, a wellhead assembly with an axis includes an outer tubular wellhead member and an inner tubular wellhead member. The inner tubular wellhead member is operable to land within the outer tubular wellhead member, defining a seal pocket between the inner tubular wellhead member and the outer tubular wellhead member. A seal ring is located in the seal pocket. An annular energizing ring selectively urges the seal ring into sealing engagement with the outer tubular wellhead member and the inner tubular wellhead member. A recess is located on one of an outer diameter of the annular energizing ring and a radially inner diameter of the seal ring, and a ratcheted retainer is located on the other of the outer diameter of the annular energizing ring and the radially inner diameter of the seal ring. A ratchet clip is located within the recess. The ratchet clip has a clip profile on a radially outward surface of the ratchet clip. The recess and the ratchet clip extend less than a full circumferential distance around the outer diameter of the annular energizing ring or the radially inner diameter of the seal ring. A retainer profile on the ratcheted retainer selectively engages the clip profile of the ratchet clip.

In another embodiment of the current disclosure, a wellhead assembly with an axis includes an outer tubular wellhead member and an inner tubular wellhead member. The inner tubular wellhead member is operable to land within the outer tubular wellhead member, defining a seal pocket between the inner tubular wellhead member and the outer tubular wellhead member. A seal ring is located in the seal pocket. The seal ring has an inner leg and an outer leg circumscribing a portion of the inner leg. An annular energizing ring has a lower end insertable between the inner and outer legs of the seal ring, so that when the lower end of the energizing ring is inserted between the inner and outer legs of the seal ring, the inner leg of the seal ring is urged radially into sealing engagement with the inner tubular wellhead member and the outer leg of the seal ring is urged radially into sealing engagement with the outer tubular wellhead member. The annular energizing ring also has a recess located on an outer diameter of the annular energizing ring. The recess extends less than a full circumferential distance around the outer diameter of the annular energizing ring. A ratchet clip is located within the recess of the annular energizing ring, the ratchet clip having circumferentially extending clip teeth on a radially outward surface of the ratchet clip. A ratcheted retainer is releasably connected to the seal ring, the ratcheted retainer having circumferentially extending retainer teeth on a radially inner diameter of the ratcheted retainer selectively mated with the circumferentially extending clip teeth of the ratchet clip.

In yet another embodiment of the current disclosure, a method for forming a seal between an inner tubular wellhead member and an outer tubular wellhead member includes positioning a seal assembly in an annulus between the inner tubular wellhead member and the outer tubular wellhead member. The seal assembly has a seal ring having a ratcheted retainer releasably connected to an upper end. The seal ring is energized by urging the seal ring toward the outer tubular wellhead member and the inner tubular wellhead member, with an annular energizing ring. The seal ring carries a ratchet clip within a recess of the annular energizing ring.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
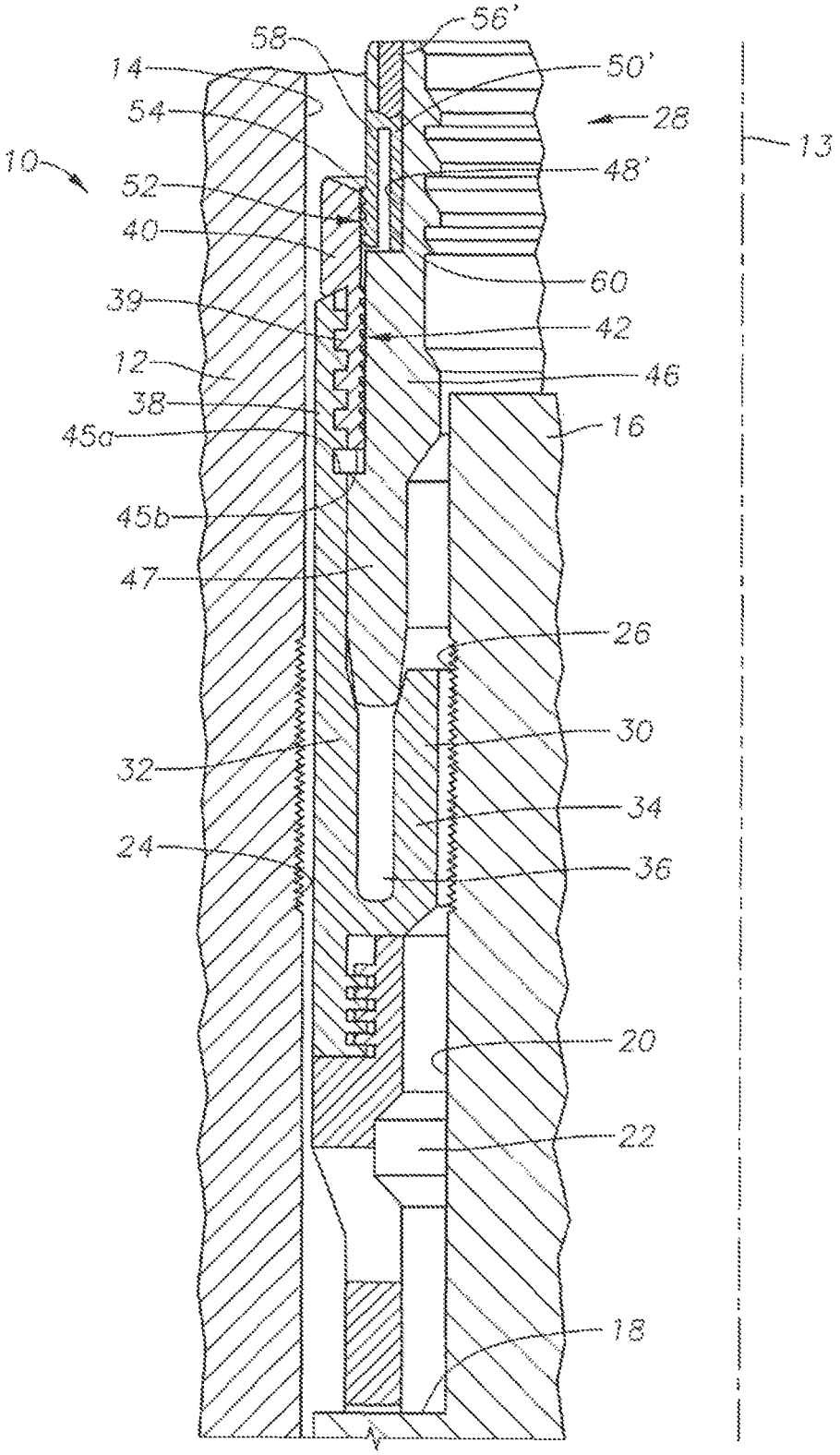
FIG. 1 is a side sectional environmental view of an embodiment of a seal assembly, positioned in an annulus between a housing and a wellhead hanger of an embodiment of this disclosure, with the energizing ring shown unset.

Referring to FIG. 1, a wellhead assembly 10 is shown. Wellhead assembly 10 includes an outer tubular wellhead member 12, such as a wellhead housing. In the illustrated embodiment, outer tubular wellhead member 12 is a conventional high pressure housing for a subsea well or a surface well. Outer tubular wellhead member 12 is a large tubular member located at the upper end of a well, such as a subsea well or a surface well. Outer tubular wellhead member 12 has axis 13 and axial bore 14 extending through it. An inner tubular wellhead member 16, such as a casing hanger, lands in axial bore 14 of outer tubular wellhead member 12. Inner tubular wellhead member 16 is a tubular conduit secured to the upper end of a string of casing or other conductor pipe (not shown). Inner tubular wellhead member 16 has an upward facing shoulder 18 on a radially outward exterior. The radially outer wall 20 of inner tubular wellhead member 16 is generally parallel to the wall of bore 14 but spaced inwardly. This results in an annular clearance or seal pocket 22 between casing hanger exterior wall 20 and the wall of bore 14.

A housing sealing surface 24 is located en an inner diameter of outer tubular wellhead member 12, which is the wall of bore 14. A hanger sealing surface 26 is located on radially outer wall 20 of inner tubular wellhead member 16, radially across bore 14 from housing sealing surface 24. As one of skill in the art will appreciate, housing sealing surface 24 and hanger sealing surface 26 can have any of a variety of surfaces such as a generally smooth surface, a texture that enhances friction while maintaining a seal, or wickers. Wickers are grooves defined by parallel circumferential ridges and valleys. Wickers are not threads. The sealing surfaces 24, 26 shown in the example of FIG. 1 as including wickers.

Referring still to FIG. 1 a seal assembly 28 lands in seal pocket 22 between casing hanger exterior wall 20 and the wall of bore 14. Seal assembly 28 is made up entirely of metal components or a combination of metal and non-metal components. These components include seal ring 30 which is annular and has a general U-shape in cross section. Seal ring 30 has an outer wall or leg 32 and a parallel inner wall or leg 34. Outer leg 32 circumscribes a portion of inner leg 34. Outer leg 32 and inner leg 34 are connected together at the bottom by a base and are open at the top. The inner diameter of outer leg 32 is radially spaced outward from the outer diameter of inner leg 34. This results in an annular clearance 36 between outer leg 32 and inner leg 34.

Outer leg 32 of seal ring 30 has an extended portion 38 that extends axially upward beyond inner leg 34. In an example embodiment, ratcheted retainer 40 is a nut that is releasably connected to an upper end of seal ring 30, at extended portion 38 of outer leg 32. In the example of FIG. 1, ratcheted retainer 40 has a lower portion with a decreased wall thickness. The lower portion has threads 39 on an outer diameter and is threaded to the upper end of seal ring 30. An upper portion of retainer 40 has a sloped downward facing surface that is defined by a change in sidewall thickness of ratcheted retainer 40. The sloped downward surface mates with a sloped upward facing surface of seal ring 30 when ratcheted retainer 40 is fully threaded onto seal ring 30. In alternate embodiments, ratcheted retainer 40 can be integrally formed with seal ring 30.

Looking at FIGS. 1-2 and 4-6, ratcheted retainer 40 has retainer profile 42 on a radially inner diameter of ratcheted retainer 40, opposite the threads 39. Retainer profile 42 includes a plurality of parallel axially spaced circumferentially extending ridges or retainer teeth 44. Each of the retainer teeth 44 has a lower surface **44*a* substantially normal to axis 13 and a sloped upward facing shoulder 44*b***.

Still looking still at FIGS. 1-2 and 4-6, annular energizing ring 46 selectively urges seal ring 30 into sealing engagement with outer tubular wellhead member 12 and inner tubular wellhead member 16. Annular energizing ring 46 has a lower end 47 insertable between inner and outer legs 32, 34 of seal ring 30, so that when lower end 47 of annular energizing ring 46 is inserted between inner and outer legs 32, 34 of seal ring 30, inner leg 32 of seal ring 30 is urged radially into sealing engagement with inner tubular wellhead member 16 and outer leg 34 of seal ring 30 is urged radially into sealing engagement with outer tubular wellhead member 12.

in embodiments having wickers, the wickers of each sealing surface 24, 26 bite into inner and outer legs 32, 34 of seal ring 30, respectively. Annular energizing ring 46 has an outer diameter that will frictionally engage the inner diameter of outer leg 34. Annular energizing ring 46 has an inner diameter that will frictionally engage the outer diameter of inner leg 32. The radial thickness of lower end 47 of annular energizing ring 46 is greater than the initial radial dimension of annular clearance 36. Annular energizing ring 46 has an upward facing shoulder **45*a* on an outer diameter that mates with a bottom surface 45*b* of ratcheted retainer 40, so that annular energizing ring 46 is retained as a part of seal assembly 28**.

Annular energizing ring 46 has recess 48'-48''' located on an outer diameter of annular energizing ring 46 and extends a short circumferential distance around the outer diameter of annular energizing ring 46. Annular energizing ring 46 can have a plurality of recesses 48'-48''' that together extend less than a full circumferential distance around annular energizing ring 46. Ratchet clip 50'-50''' is located within each recess 48'-48''' of annular energizing ring 46 so that ratchet clips 50'-50''', when considered together, also extend less than a full circumferential distance around annular energizing ring 46. The plurality of ratchet clips 50'-50''', can each be generally rectangular and located in an individual recess 48'-48''' spaced around the circumference of annular energizing ring 46. Ratchet clip 50'-50''' has clip profile 52 on a radially outward surface of ratchet clip 50'-50'''. Clip profile 52 of ratchet clip 50'-50''' has a plurality of axially spaced circumferentially extending clip teeth 54. Retainer teeth 44 and clip teeth 54 are sized and spaced to mate with the each other. Retainer teeth 44 of retainer profile 42 of ratcheted retainer 40 can mate with and selectively engage clip teeth clip 54 of clip profile 52 of ratchet clip 50'-50'''. Each of the clip teeth 54 has an upper surface 54*a* substantially normal to axis 13 and sloped downward facing shoulder 54*b*. As will be further described below, ratchet clip 50'-50''' is biased to retain clip teeth 54 in engagement with the retainer teeth 44. A retainer member 56'-56''' retains ratchet clip 50'-50''' within recess 48'-48'''.

Although ratchet clip 50'-50''' has been shown and described as being in a recess 48'-48''' of annular energizing ring 46 and ratcheted retainer 40 has been shown and described as being located on seal ring 30, in alternate embodiments, the configuration can be reversed. In such a case, ratchet clip 50'-50''' can be located in a recess 48'-48''' of seal ring 30 and ratcheted retainer 40 can be located on annular energizing ring 46.

Figure 2:
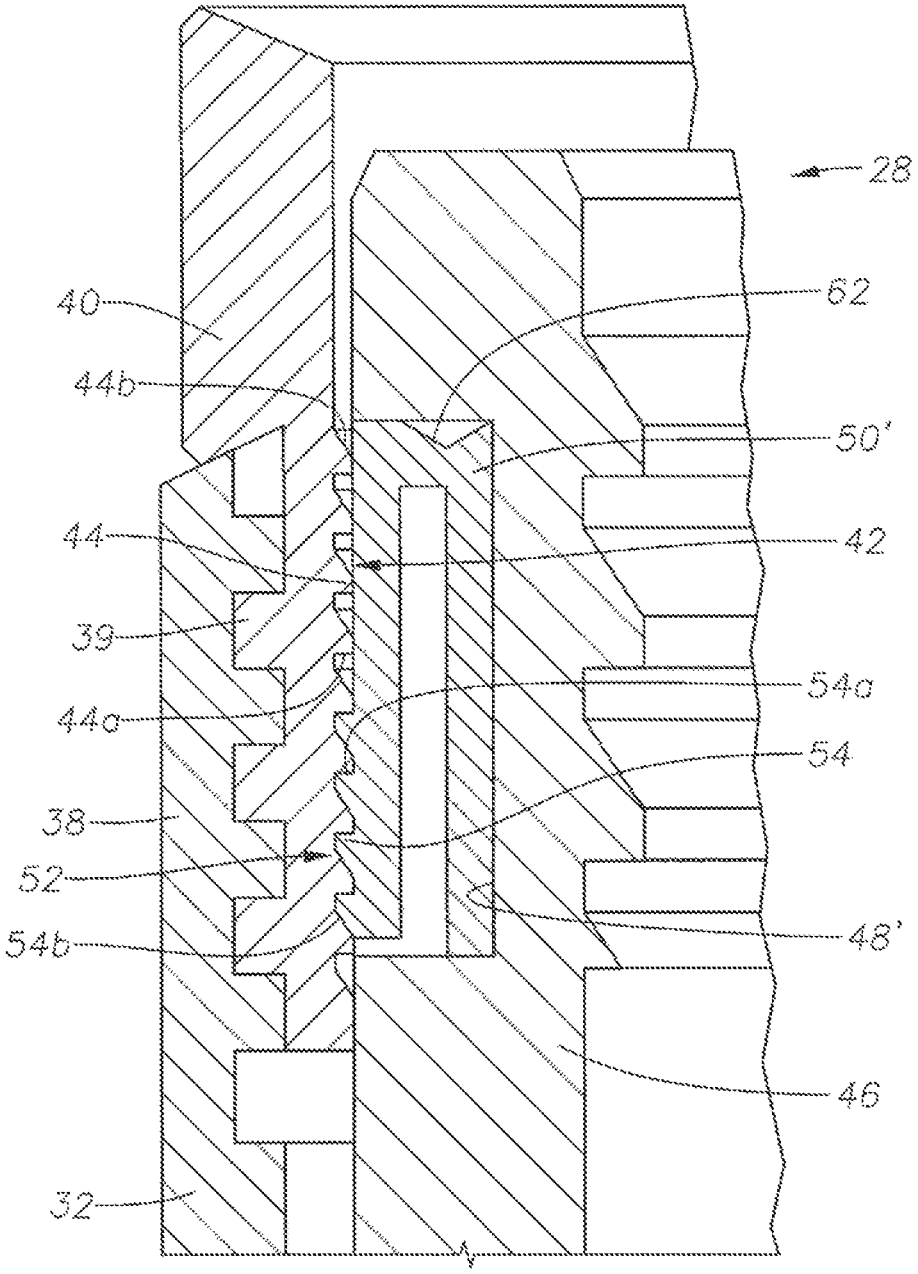
FIG. 2 is a section view of a portion of the seal assembly of FIG. 1, with the energizing ring shown set.

Looking now at FIGS. 1-2, ratchet clip 50' has a general upside down U-shape in cross section. Ratchet clip 50' has clip outer leg 58 and clip inner leg 60. Clip outer leg 58 and clip inner leg 60 are connected together at the top by a crown and are open at the bottom. Clip profile 52 is located on a radially outward surface of outer leg 58. In a relaxed position, the radial width of the open bottom of ratchet clip 50' is larger than the radial width of recess 48'. As annular energizing ring 46 is pushed axially downward and into seal ring 30, the bottom end of clip outer leg 58 is squeezed towards clip inner leg 60 to allow ratchet clip 50' to slide past a smooth upper portion of ratcheted retainer 40. This squeezing action of clip outer leg 58 biases ratchet clip 50' to cause clip outer leg 58 to apply constant radial outward force on ratcheted retainer 40 so that once clip profile 52 is engaged with retainer profile 42, clip profile 52 remains in engagement with retainer profile 42. The flexibility of clip outer leg 58 also allows clip outer leg 58 to bend further axially inward as clip teeth 52 pass over retainer teeth 44 so that seal assembly 28 can be set with a minimal increase in the setting load compared to the forces required to move the energizing ring 46 axially downward before clip teeth 52 meet retainer teeth 44.

In the embodiment illustrated in FIGS. 1-2, clip outer leg 58 and clip inner leg 60 of ratchet clip 50' are curved to generally match the curvature of energizing ring 46. Ratchet clip 50' has an indent 62 along the crown. Indent 62 can receive a bottom of retainer 56' so that retainer 56' can retain ratchet clip 50' within recess 48'. Recess 48' is generally rectangular in cross section, having an axial height that is greater than a radial width.

Figure 3:
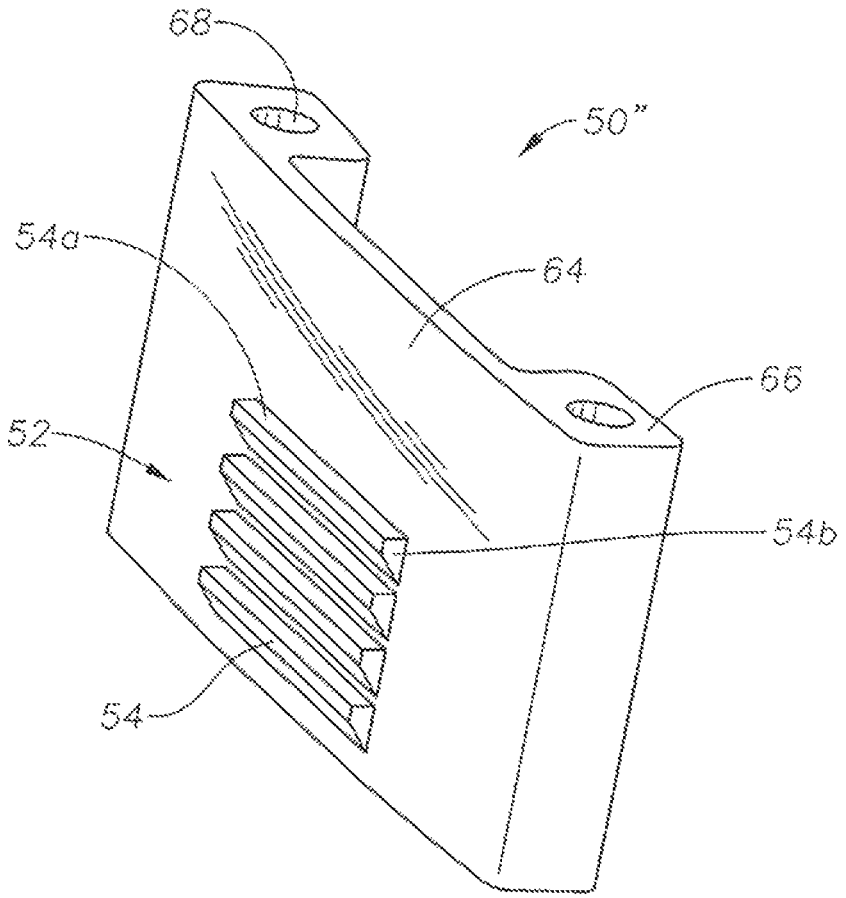
FIG. 3 is a perspective view of a ratchet clip in accordance with an embodiment of this disclosure.
Figure 4:
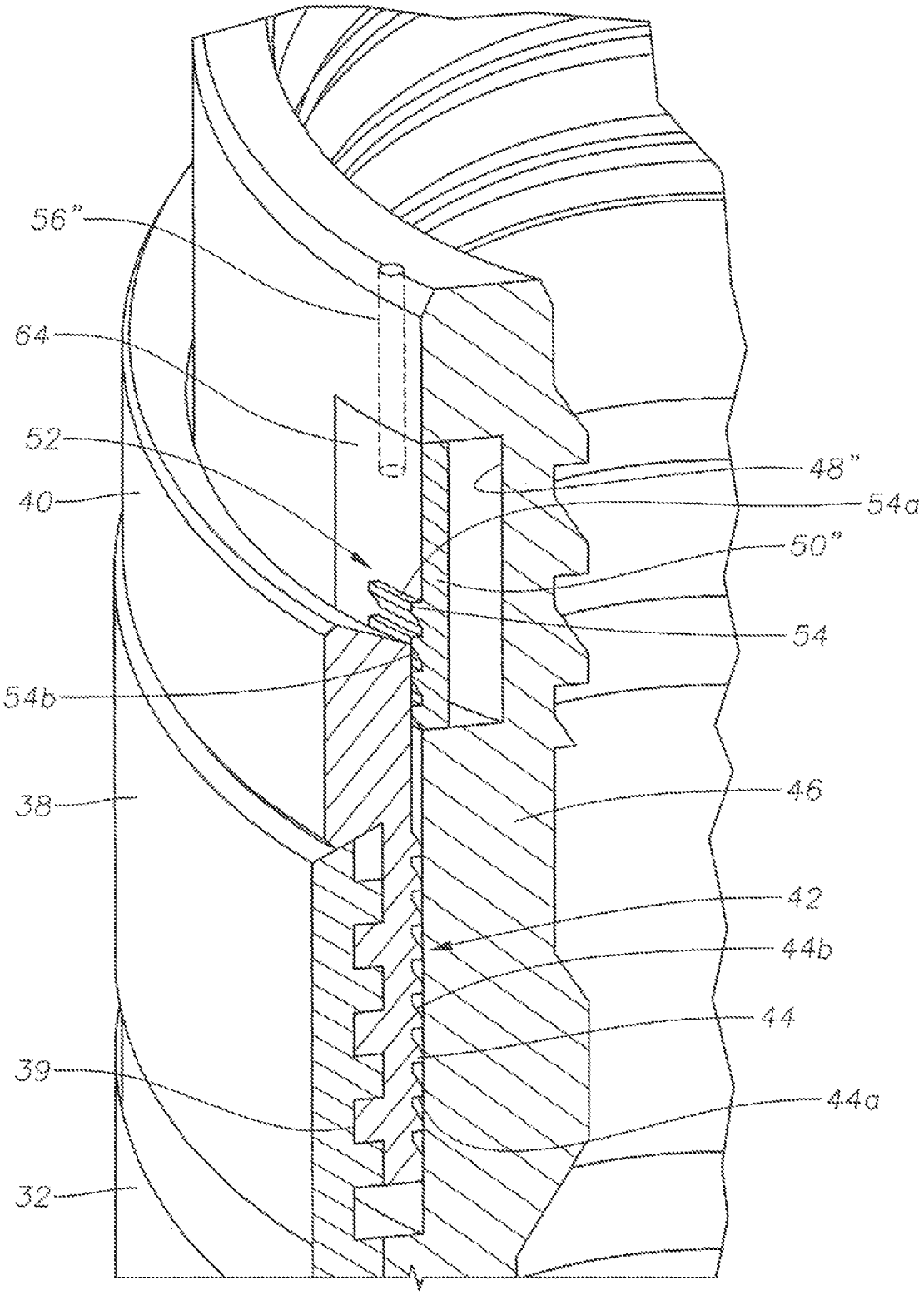
FIG. 4 is a sectional perspective view of a portion of a seal assembly with the ratchet clip of FIG. 3, with the energizing ring shown unset.

Turning now to FIGS. 3-4, ratchet clip 50'' comprises curved plate member 64. Curved plate member 64 has a greater radial width than an axial height, and has an outer surface, an inner surface and two axially extending sides. Clip profile 52 is located on the outer surface of plate member 64. Support members 66 protrude from the inner surface of plate member 64 and along the height of each of the axially extending sides of plate member 64. Support members 66 have an opening 68 at a top end that can receive a bottom of retainer 56'' so that retainer 56'' can retain ratchet clip 50'' within recess 48. Recess 48'' is generally rectangular in cross section, having an axial height that is greater than a radial width.

In a relaxed position with ratchet clip 50'' retained within recess 48'' curved plate member 64 of ratchet clip 50'' is bowed outward so that clip profile 52 protrudes radially outward past the outer diameter of annular energizing ring 46. As annular energizing ring 46 is pushed axially downward and into seal ring 30, curved plate member 64 is offset radially and resiliently inward to allow ratchet clip 50'' to slide past the smooth upper portion of ratcheted retainer 40. This radial offset of curved plate member 64 biases ratchet clip 50'' to cause curved plate member 64 to apply constant radial outward force on ratcheted retainer 40 so that once clip profile 52 is engaged with retainer profile 42, clip profile 52 remains in engagement with retainer profile 42. The radial flexibility of curved plate member 64 also allows curved plate member 64 to bend further axially inward as clip teeth 52 pass over retainer teeth 44 so that seal assembly 28 can be set with a minimal increase in the setting load compared to the forces required to move the energizing ring 46 axially downward before clip teeth 52 meet retainer teeth 44.

Figure 5:
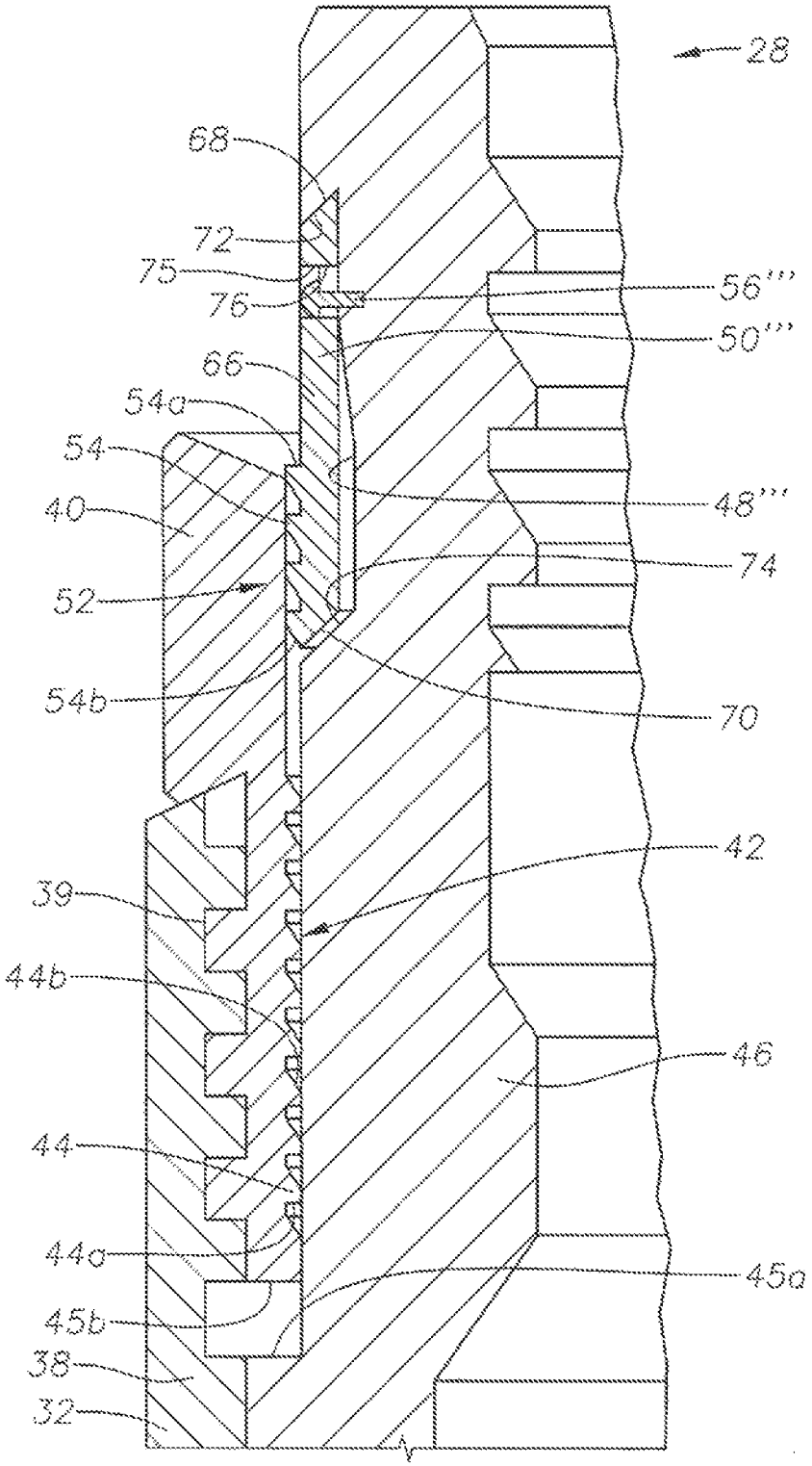
FIG. 5 is a section view of a portion of the seal assembly in accordance with an embodiment of this disclosure, with the energizing ring shown unset.
Figure 6:
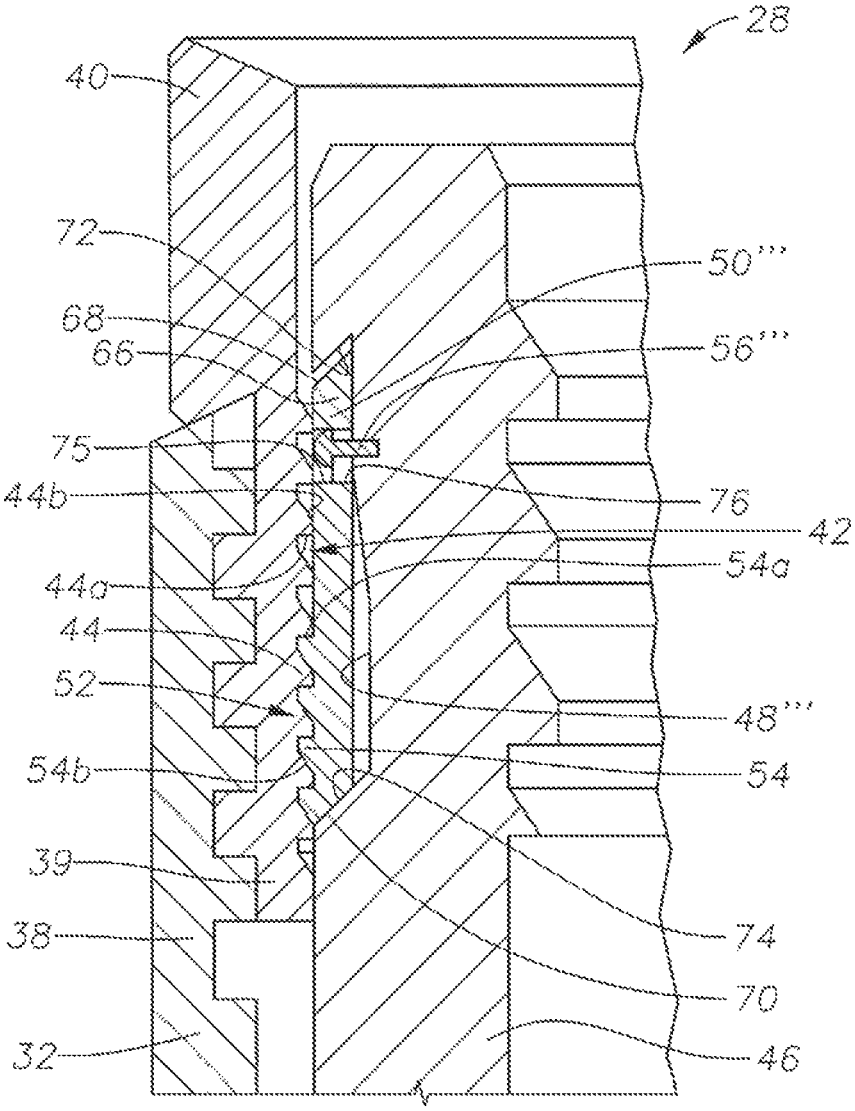
FIG. 6 is a section view of the portion of the seal assembly of FIG. 5, with the energizing ring shown set.

Turning now to FIGS. 5-6, ratchet clip 50''' has curved tab member 66 which has a greater axial height than radial width. Ratchet clip 50''' has a top end 68 and a bottom end 70, each of the top end 68 and bottom end 70 extending from a radially inner surface to the radially outward surface of curved tab member 66. Each of the top end 68 and bottom end 70 have end surfaces that slope downward from the radially inner surface to the radially outward surface of tab member 66.

Recess 48''' has a an upper shoulder 72 and a lower shoulder 74, each of the upper shoulder 72 and the lower shoulder 74 sloping downwards in a radially outward direction. The angle of the slope of lower shoulder 74 is selected such that during operation, even if annular energizing ring 46 applies upward force on ratchet clip 50''', gravity acting on ratchet clip 50''' causes ratchet clip 50''' to remain at a lower radially outward end of lower shoulder 74, biasing ratchet clip 50''' so that clip profile 52 remains in engagement with retainer profile 42. Recess 48''' has a depth proximate to upper shoulder 72 that is less than the axial depth of recess 48''' at lower shoulder 74.

Ratchet clip 50''' has a recessed slot 75 open to the radially outward surface of ratchet clip 50'''. Bore 76 extends through ratchet clip 50''' at the recessed slot 75. Retainer 56''' extends through recessed slot 75 and bore 76 and into annular energizing ring 46. Retainer 56''' can be a threaded screw. An end of retainer 56''' is secured to annular energizing ring 46 be threading retainer 56''' into a threaded hole of annular energizing ring 46. Bore 76 has a greater axial height than radial width to allow relative axial movement of retainer 56''' and bore 76, allowing axial movement of ratchet clip 50''' relative to retainer 56'''. The axial height of recess 48''' is greater than the axial height of ratchet clip 50''' so that ratchet clip 50''' can move axially relative to annular energizing ring 46.

In an example of operation, in preparing seal assembly 28, ratchet clip 50'-50''' can be attached directly to energizing ring 46 with retainer 56'-56'''. No press or other special tools is required to attach ratchet clip 50'-50''' to energizing ring 46. Lower end 47 of energizing ring 46 can be located between an upper end inner and outer legs 32, 34 of seal ring 30 and ratcheted retainer 40 can be threaded onto extended portion 38 of outer leg 32 of seal ring 30. Seal assembly 28 can be lowered into seal pocket 22, between inner tubular wellhead member 16 and outer tubular wellhead member 12. A bottom end of seal assembly 28 can land on upward facing shoulder 18 of inner tubular wellhead member 16.

Seal ring 30 can then be energized by urging seal ring 30 toward outer tubular wellhead member 12 and inner tubular wellhead member 16 with energizing ring 46. This can be accomplished by inserting lower end 47 of annular energizing ring 46 between inner and outer legs 32, 34 of seal ring 30; inner leg 32 of seal ring 30 is urged radially into sealing engagement with inner tubular wellhead member 16 and outer leg 34 of seal ring 30 is urged radially into sealing engagement with outer tubular wellhead member 12.

Annular energizing ring 46 will be moved axially toward seal ring 30 until retainer profile 42 of ratcheted retainer 40 mates with clip profile 52 of ratchet clip 50'-50'''. Clip teeth 54 and retainer teeth are saw toothed in configuration so that as clip teeth 54 pass by retainer teeth 44, sloped downward facing shoulder 54*b* of clip teeth 54 will slidingly engage upward facing shoulder 44*b* of retainer teeth 44. This will allow clip teeth 54 to smoothly and efficiently pass by retainer teeth 44. When the desired final location of annual energizing ring 46 relative to seal ring 30 has been reached, upper surface 54*a* of clip teeth 54 will engage lower surface 44*a* of retainer teeth 44 so that energizing ring 46 cannot back out of annular clearance 36 of seal ring 30.

Because of the number of clip teeth 54 and retainer teeth 44, the operator will have a range of positions in which annular energizing ring 46 can be axially limited by ratcheted retainer 40 with the mating of clip teeth 54 and retainer teeth 44. Therefore, the operator can position annular energizing ring 46 in the desired location in order to provide seal assembly 28 with a desired pressure rating without having to overshoot or undershoot the ideal location due to a relative short variance, or even a single location of axially limiting the movement of seal ring 30.

If the operator desires to remove seal assembly 28, sufficient upward force can be applied to annular energizing ring 46 to shear one or both of the clip teeth 54 and retainer teeth 44 so that annular energizing ring 46 will move out of annular clearance 36 of seal ring 30. As annular energizing ring 46 continues to move axially upwards, the upward facing shoulder 45*a* on the outer diameter of energizing ring 46 will mate with the bottom surface 45*b* of ratcheted retainer 40, so that seal ring 30 is also moved axially upwards and can be removed from wellhead assembly 10.

While the invention has been shown or described in only some of its forms, it should be apparent to those skilled in the art that it is not so limited, but is susceptible to various changes without departing from the scope of the invention.

What is claimed is:

1. A wellhead assembly having an axis, comprising:

an outer tubular wellhead member;

an inner tubular wellhead member, the inner tubular wellhead member being operable to land within the outer tubular wellhead member, defining a seal pocket between the inner tubular wellhead member and the outer tubular wellhead member;

a seal ring located in the seal pocket;

a ratcheted retainer releasably connected to the seal ring and composed of a different material from the seal ring;

an annular energizing ring selectively urging the seal ring into sealing engagement with the outer tubular wellhead member and the inner tubular wellhead member, a recess located on one of an outer diameter of the annular energizing ring and a radially inner diameter of the ratcheted retainer;

a ratchet clip located within the recess, the ratchet clip having a clip profile on a radially outward surface of the ratchet clip, and wherein the recess and the ratchet clip extend less than a full circumferential distance around the outer diameter of the annular energizing ring or the radially inner diameter of the ratcheted retainer; and a retainer profile on the ratcheted retainer or the annular energizing ring, the retainer profile selectively engaged with the clip profile of the ratchet clip.

2. The assembly according to claim 1, wherein the seal ring has a general u-shape in cross section.

3. The assembly according to claim 1, wherein the ratchet clip is biased toward the retainer profile to retain the clip profile in engagement with the retainer profile.

4. The assembly according to claim 1, wherein:

the clip profile comprises a plurality of axially spaced clip teeth extending circumferentially around a portion of the annular energizing ring; and the retainer profile comprises a plurality of axially spaced retainer teeth extending a full circumference of the seal ring, the retainer teeth being sized and spaced to mate with the clip teeth.

5. The assembly according to claim 1, wherein:

the clip profile comprises a plurality of axially spaced and circumferentially extending clip teeth, each of the clip teeth having an upper surface substantially normal to the axis and a sloped downward facing shoulder; and the retainer profile comprises a plurality of axially spaced and circumferentially extending retainer teeth, each of the retainer teeth having a lower surface substantially normal to the axis and a sloped upward facing shoulder.

6. The assembly according to claim 1, wherein the ratchet clip comprises a clip outer leg and a clip inner leg and the radially outward surface of the ratchet clip having the clip profile is located on the clip outer leg.

7. The assembly according to claim 1, wherein:

the ratchet clip comprises a curved plate member having an outer surface, an inner surface, and two axially extending sides;

the radially outward surface of the ratchet clip having the clip profile is located on the outer surface; and a support member protrudes from the inner surface along a height of each of the axially extending sides.

8. The assembly according to claim 1, wherein the ratchet clip has a top end and a bottom end, each of the top end and bottom end extending from a radially inner surface to the radially outward surface, and each of the top end and bottom end having an end surface that slopes downward from the radially inner surface to the radially outward surface.

9. The assembly according to claim 1, wherein:

the ratchet clip has a recessed slot open to a radially outward surface of the ratchet clip, and a bore that extends through ratchet clip at the recessed slot, a retainer extends through the recessed slot and the bore and into the annular energizing ring; and the bore has a greater axial height than radial width to allow axial movement of the ratchet clip relative to the retainer.

10. The assembly according to claim 1, wherein the recess of the annular energizing ring has an upper shoulder and a lower shoulder, each of the upper shoulder and the lower shoulder sloping downwards in a radially outward direction.

11. A wellhead assembly having an axis, comprising:

an outer tubular wellhead member;

an inner tubular wellhead member, the inner tubular wellhead member being operable to land within the outer tubular wellhead member, defining a seal pocket between the inner tubular wellhead member and the outer tubular wellhead member;

a seal ring located in the seal pocket, wherein the seal ring has an inner leg and an outer leg circumscribing a portion of the inner leg;

an annular energizing ring having a lower end insertable between the inner and outer legs of the seal ring, so that when the lower end of the energizing ring is inserted between the inner and outer legs of the seal ring, the inner leg of the seal ring is urged radially into sealing engagement with the inner tubular wellhead member and the outer leg of the seal ring is urged radially into sealing engagement with the outer tubular wellhead member, the annular energizing ring further having a recess located on an outer diameter of the annular energizing ring, the recess extending less than a full circumferential distance around the outer diameter of the annular energizing ring;

a ratchet clip located within the recess of the annular energizing ring, the ratchet clip having circumferentially extending clip teeth on a radially outward surface of the ratchet clip; and a ratcheted retainer releasably connected to the seal ring and composed of a different material from the seal ring, the ratcheted retainer having circumferentially extending retainer teeth on a radially inner diameter of the ratcheted retainer selectively mated with the circumferentially extending clip teeth of the ratchet clip.

12. The assembly according to claim 11, wherein the seal ring has a general u-shape in cross section and the outer leg has an extended portion that extends axially upward beyond the inner leg.

13. The assembly according to claim 12, wherein the ratcheted retainer is attached to the extended portion of the outer leg.

14. The assembly according to claim 11, wherein:

the clip teeth each have an upper surface substantially normal to the axis and a sloped downward facing shoulder; and the retainer teeth each have a lower surface substantially normal to the axis and a sloped upward facing shoulder.

15. The assembly according to claim 11, further comprising a retainer member retaining the ratchet clip within the recess.

16. The assembly according to claim 11, wherein the ratchet clip is biased to retain the retainer teeth in engagement with the clip teeth.

* * * * *